US012692068B2

(12) United States Patent
Bahr et al.

(10) Patent No.: US 12,692,068 B2
(45) Date of Patent: Jul. 28, 2026

(54) INLINER, COMPOSITE PACKAGE AND TRANSPORT CONTAINER WITH AN INLINER, AND ASSOCIATED METHOD

(71) Applicants: Ulrich Bahr, Lossburg (DE); Fabian Haas, Lossburg (DE)

(72) Inventors: Ulrich Bahr, Lossburg (DE); Fabian Haas, Lossburg (DE)

( * ) Notice: Subject to any disclaimer, the term of this patent is extended or adjusted under 35 U.S.C. 154(b) by 0 days.

(21) Appl. No.: 19/271,963

(22) Filed: Jul. 17, 2025

(65) Prior Publication Data

US 2026/0015159 A1 Jan. 15, 2026

Related U.S. Application Data

(63) Continuation of application No. PCT/EP2024/075490, filed on Sep. 12, 2024.

(51) Int. Cl.

*B65D 88/54* (2006.01)
*B65B 69/00* (2006.01)
*B65D 88/16* (2006.01)

(52) U.S. Cl.

CPC ..... *B65D 88/54* (2013.01); *B65B 69/0091* (2013.01); *B65D 88/1631* (2013.01)

(58) Field of Classification Search

CPC .. B65B 69/0091; B65D 88/54; B65D 90/046; B65D 90/047; B65D 90/048; B65D 77/06; B65D 77/062; B65D 77/26; B65D 77/061; B65D 2590/04; B65D 2590/043; B65D 2590/046; B65D 88/1631

USPC .. 220/495.08, 495.01, 495.06, 651, 653, 1.6

See application file for complete search history.

(56) References Cited

U.S. PATENT DOCUMENTS

| | | | | |
|---|---|---|---|---|
| 4,996,760 | A | 3/1991 | Coleman | |
| 2010/0252476 | A1 * | 10/2010 | Kreger | B65D 88/1618 206/524.6 |
| 2022/0267084 | A1 * | 8/2022 | Lawrence | B65D 90/046 |

FOREIGN PATENT DOCUMENTS

| | | | | |
|---|---|---|---|---|
| DE | 202014105594 | U1 | 1/2015 | |
| DE | 202019102700 | U1 * | 5/2019 | B65D 77/061 |
| EP | 2964540 | B1 | 1/2017 | |
| EP | 3272676 | A1 * | 1/2018 | B65D 88/1631 |
| KR | 102105272 | B1 * | 4/2020 | B65D 88/1631 |
| WO | WO-0037332 | A1 * | 6/2000 | B65D 51/1644 |

OTHER PUBLICATIONS

English Machine Translation of KR-102105272-B1 (Year: 2020).*

(Continued)

*Primary Examiner* — Laura E. Parker

(74) *Attorney, Agent, or Firm* — CANTOR COLBURN LLP

(57) ABSTRACT

An inliner, for receiving filling material and for being introduced through an opening into a container wall of a transport container, the inliner including shaping rods configured to open with the inliner in the transport container in a direction radially outward of an axis in a manner of an umbrella when the inliner is introduced into the transport container and to close in a direction radially inward of the axis when the inliner is extracted, where the shaping rods are composed of a flexible, resilient material and, as a result of an internal stress, are transferable from a deformed position into a rest position corresponding to the open position of the inliner.

14 Claims, 5 Drawing Sheets

(56) References Cited

OTHER PUBLICATIONS

English Machine Translation of DE-202019102700-U1 (Year: 2019).*
English Machine Translation of WO-0037332-A1 (Year: 2000).*
International Search Report for corresponding application PCT/EP2024/075490 filed Sep. 12, 2024; Mail date Dec. 10, 2024.

* cited by examiner

INLINER, COMPOSITE PACKAGE AND TRANSPORT CONTAINER WITH AN INLINER, AND ASSOCIATED METHOD

CROSS REFERENCE TO RELATED APPLICATIONS

This is a continuation of International Patent Application Number PCT/EP2024/075490 filed on 12 Sep. 2024, which claimed priority to German Patent Application Number 102023124778.6 filed on 13 Sep. 2023, both of which said applications are incorporated herein by reference in their entirety.

TECHNICAL FIELD

The disclosure relates to an inliner, a composite package with such an inliner, a transport container provided with such an inliner, and a method for introducing an inliner into a transport container.

BACKGROUND

Transport containers for transporting, for example, liquid, paste-like or free flowing goods to be transported are made of liquid tight plastics bodies, which are usually blow moulded. For transport, such transport containers are received upright on a pallet within a lattice or a sheet metal casing. Intermediate bulk containers (IBCs) are used in industry and trade as an extremely economical and cost effective transport means for liquids and, for example, pastes to be transported. They consist of a sturdy lattice box into which a blow moulded plastics tank container provided with at least one, usually several, filling and emptying fittings is inserted. As a rule, these transport containers have volumes of 500 or 1000 litres up to 1800 litres or even more. However, in the context of this document, the term "transport container" also includes other transport containers, such as transport containers for use in other filling and transport areas, which can be made of stainless steel, for example. In principle, a transport container made of other materials is also usable in accordance with the disclosure, for example made of glass or cardboard packaging.

IBC transport containers are filled, for example, with paints, pastes, acids, alkaline solutions, oils and other products from the chemical, food producing, medical and pharmaceutical industries for transport and are transported in this state to the users. However, they can also be used in many cases for the provision of drinking or cleaning water, for example in crisis situations or disasters.

It is also known to provide a thin walled, flexible film, that is also, for example, substantially tubular and/or is moulded in a manner adapted to the shape of the inner contour, as an inner sleeve within such a transport container. Such inner sleeves are called inliners or also film inliners and are referred to as "inliners" hereinafter in this document.

As the transport containers are usually used multiple times and, depending on the application, are contaminated by the filling material, without an inliner it is usually necessary to clean the transport container carefully after emptying such a transport container before refilling it. This is done manually using pressure and steam jets or corresponding automatic cleaning systems. The cleaning process is usually very water intensive and produces a large amount of waste water, some of which has to be treated and disposed of. This cleaning process and the disposal of the washing liquids are very time consuming and cost intensive and are subject to strict regulations, which are also constantly being tightened. This cleaning is often carried out at specially equipped stations. This requires transport capacities for the delivery of the contaminated containers and the return transport to the filling facility.

Instead of cleaning the transport container, it can be provided with the inliners, which, insofar as being flexible and adapted to the shape of the transport container, form a tight inner lining. This inner lining can be removed after use and recycled or, if contaminated, subjected to a thermal recovery process. This thermal reutilisation is recommended due to the high energy content of the plastics materials.

DE 20 2014 105 594 U1 discloses an inner sleeve in the form of an inliner for introduction through an opening of a transport container, wherein the inliner comprises a connection adapter for filling and a connection adapter for emptying. These adapters can be attached in the region of a filling opening and an outlet opening of the transport container. The adapters and inliner form a prefabricated composite. They are attached to the transport container by connection means, provided on the transport container, in which the adapters are screwed over the corresponding threads and then clamped to the sealing lids or the emptying fitting. The inner sleeve has an unfolding aid which connects two portions of the inner sleeve that are at a distance from each other before installation in the liquid container or keeps them at a defined spacing from each other and which is arranged to detach or tear open or tear off or to rip at least on one side when the unfolding aid is unfolded inside the liquid container. This allows the order in which the inner sleeve is opened to be predetermined in a targeted way. This ensures that a bottom portion of the inner sleeve that is used at the bottom is applied to the container without creases. The bottom side in particular must be fold free, as folds there would disrupt the discharge behaviour from the container. In addition, the inner sleeve is inserted into the container in a folded state. There is a high risk that the inner sleeve will lie against the liquid container such that these original folds will remain. After creating a relative overpressure within the inner sleeve, it inflates so that existing folds are stretched and smoothed out. The relative overpressure is created by the fact that portions of the inner sleeve that do not serve as a base are prevented from unfolding if the unfolding aid is not torn or opened. After opening the unfolding aid(s), the inner sleeve can lay against the inner wall of the container with fewer folds.

EP 2 964 540 B1 discloses a pallet container and a method for folding an inliner that is introduced into the pallet container. The inliner can be easily introduced into the transport container by folding it accordingly. Excess gas escaping from the transported goods can be drained by means of a degassing nozzle. A flexible corrugated pipe with a multiplicity of lateral holes is also provided in the region of the base fitting as a means of improving the residual emptying of the transported goods, so that the transport container can be emptied almost completely. The pipe is screwed to the bottom of the transport container at the filling and removal fitting independently of the inliner.

A common feature of the prior art is that it has so far been very complex to provide the transport container with an inliner in such a way that it lies optimally against the inner walls of the container in order to prevent strong fold formation of the hollow inliner. A strong folded connection is disadvantageous during subsequent filling, as pockets are created in the lining which put the material under stress and may lead to damage of the lining and thus to leakage of the transported goods. A complete and clean unfolding of the inner lining and thus of the inliner in the transport container would therefore be advantageous.

There are already various solutions for cleaning, but these have always failed due to the fact that

- the introduction of the inliner into the IBC is very complex
- the inliner cannot be positioned in the IBC (the inliner must be inserted for filling with the inliner base in a rectangular shape exactly according to the IBC inner base, since otherwise bubble voids form between the inliner and the inner wall of the outer container during filling, which in turn may favour bursting or tearing of the inliner due to overstressing of the film)
- inflating an inserted inliner does not bring it into the correct shape
- if the inliner is not positioned correctly in the base region of the IBC, air bubbles are created between the inliner film and the inner wall of the IBC, and, as mentioned above, may lead to rupture or tearing of the inliner film in the worst case
- the inliner may burst open during removal after emptying, and residual quantities of filling material may contaminate the IBC.

BRIEF SUMMARY

The disclosure addresses the problem of providing an inliner, a composite package, a transport container equipped with an inliner, and a method in which optimum placement of the inliner against the wall of the transport container is ensured, but at the same time easy introduction for filling and removal after emptying of the inliner is also possible.

An inliner, preferably a film inliner, is to be devised which is drawn into a transport container, such as an IBC container, before filling and can be clean and even aseptic or sterile on request. The inliner should be able to be inserted into the transport container without additional devices or mechanical aids in such a way that it is optimally positioned for filling in the container, namely is aligned according to the shape of an inner surface, preferably the inner base, of the transport container. If this alignment is not achieved, there will be considerable folds in the wall of the inliner during filling, which may lead to the formation of bubbles between the inner wall of the IBC transport container and the inliner. As a result, the static weight of the filling material is no longer fully taken up by the transport container and, in the worst case, the inliner may tear.

The inliner is configured to receive filling material and to be introduced through an opening in a container wall of a transport container. The inliner is operatively connected to shaping rods which are configured to open with the inliner in the transport container similarly to the umbrella principle when the inliner is introduced into the transport container and to close when the inliner is extracted. This advantageously enables the inliner to be positioned in the transport container in an oriented manner, preferably on its base surface, thereby eliminating the problems associated with prior art solutions.

The shaping rods have a flexible, resilient material and, due to their internal stress, are transferable from a deformed position to a rest position, which corresponds to an open position of the inliner. Advantageously, inliners and shaping rods can thus be easily inserted or removed through the filling opening of the transport container. In the relaxed rest position, they then assume the desired position in the transport container.

In a preferred exemplary embodiment, on the inliner there are provided fixing elements, at which the shaping rods are securable. This advantageously creates the desired operative connection in order to be able to position the shaping rods in a targeted manner and in any position.

Preferably, the inliner is provided with at least two shaping rods which, in the rest position, lie one above the other at at least one point and stretch an area at the corners of which the fixing elements are provided. Advantageously, an area adapted to the respective transport container or to at least one of its inner surfaces can thus be stretched and reliably covered.

In a preferred exemplary embodiment, the stretched area covers an inner surface, preferably a base surface, of the transport container in order to advantageously counteract the formation of folds and cover the entire surface. This advantageously counteracts possible damage to the inliner when filling with filling material.

Preferably, the shaping rods are glass fibre rods, which advantageously have the desired properties and the internal stress to assume a predetermined position in the initial state. However, other materials with corresponding properties are also usable. Preferably, the shaping rods are made of inexpensive and/or recyclable materials in order to keep the costs for the inliner low.

In a preferred exemplary embodiment, the inliner and shaping rods in their deformed position are receivable in an application tube, the outer dimensions of which are smaller in cross section than the filling opening of the transport container. This allows the inliner advantageously to be easily inserted into the transport container manually.

The disclosure provides also a composite package configured for introduction of an inliner through an opening in a container wall of a transport container, said composite package comprising

- an inliner, equipped with shaping rods, as already described,
- an application tube, in which there are receivable the inliner and the shaping rods in their deformed position and of which the outer dimensions are smaller in cross section than a filling opening of the transport container.

Advantageously, this composite package enables a prefabricated solution that makes it easier for the user to place the inliner in the transport container while ensuring that the transport container is not contaminated.

In a preferred exemplary embodiment, the composite package additionally has a moulded part which is arranged to fix the inliner after introduction into the transport container to the filling opening thereof, the moulded part preferably having air holes. This advantageously ensures on the one hand that the inliner can be filled without any problems, but at the same time air displaced in the transport container can escape easily.

The disclosure provides also a transport container equipped with an inliner as described above.

Preferably, the transport container is formed in such a way that it has a filling opening and optionally an outlet opening and is provided with the inliner arranged in the transport container, the inliner being securable at the filling opening. This advantageously makes it possible to fill or empty the container without the inliner slipping and thus without contaminating the transport container.

The disclosure provides likewise a method for introducing an inliner into a transport container through an opening in a container wall of the transport container, said method having the steps of:

establishing an operative connection between shaping rods and inliner, transferring the shaping rods into a deformed, resettable position by inserting shaping rods and inliner into an application tube, introducing the application tube with the inliner and shaping rods received therein through a filling opening into the transport container, pulling off the application tube while releasing the shaping rods, which thereby stretch the inliner and move to their rest position on a base surface of the transport container, optionally filling the inliner in the transport container with filling material.

Advantageously, the transport container can thus easily be provided with the inliner in such a way that contamination of the transport container is reliably avoided.

The following steps are preferably carried out to empty the inliner in the transport container:

removing the filling material, preferably by pumping, suctioning by means of a suction lance and suction pump through the filling opening or emptying through a valve, optionally down to a residual quantity of filling material, pulling the inliner upwards to form a sump, preferably above the shaping rods, removing filling material from the sump, preferably by pumping through a suction lance, removing the inliner from the transport container.

By pulling the inliner and suctioning/pumping it out, for example using a special suction lance, it can be ensured that residual quantities are also removable as far as possible before the inliner is removed from the transport container, so that the emptied inliner can be removed advantageously effortlessly through the filling opening by hand or with a pull out device.

For the emptying process, the inliner should be able to be emptied almost completely down to the smallest residual quantities either by suctioning or by emptying, for example through a valve of the transport container. The inliner contaminated by the filling material should then be easy for the user to remove for disposal. The inliner should not be damaged during removal, as any small residual quantities that may still be present may flow out of the inliner in the event of damage, thereby contaminating the transport container.

BRIEF DESCRIPTION OF THE FIGURES

The disclosure is explained in greater detail below with reference to the exemplary embodiments shown in the attached Figures.

DETAILED DESCRIPTION

Before describing the disclosure in detail, it should be pointed out that it is not limited to the various components of the device and the various method steps, as these components and methods may vary. The terms used herein are merely intended to describe particular embodiments and are not used in a limiting manner. Furthermore, when the singular or indefinite articles are used in the disclosure, this also refers to the plurality of these elements, unless the overall context clearly indicates otherwise.

When the term "filling material" 40 is used in these documents, it refers in particular to, for example, liquid, paste-like or free flowing transport goods with which transport containers such as IBC containers are filled in order to transport these goods.

Figure 6:
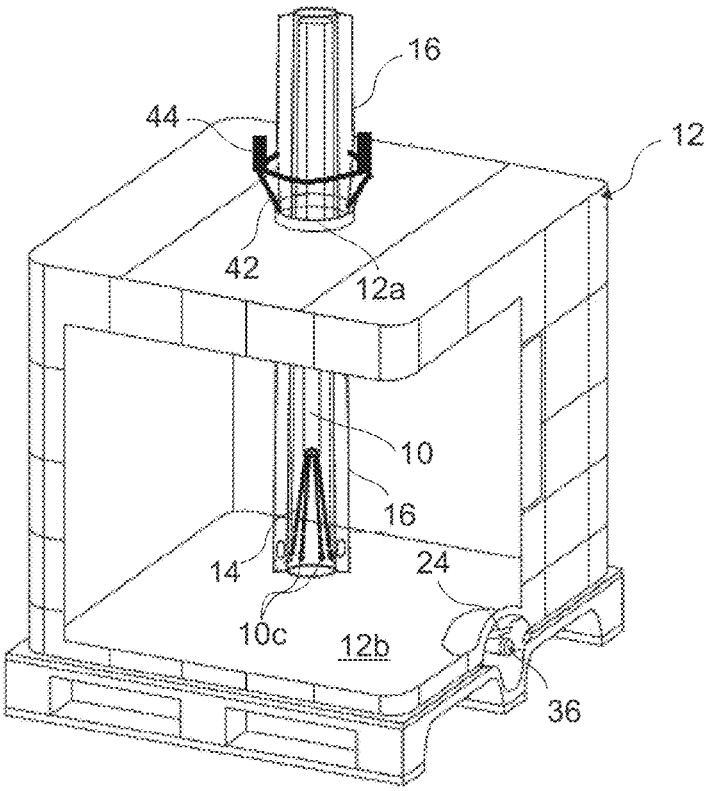
FIG. 6*a* an insertion funnel for inserting the inliner protected by the application tube into the transport container, FIG. 8 an illustration of the transport container in accordance with FIG. 6 with an inliner introduced therein, FIG. 9, 10 illustrations of the transport container in accordance with FIG. 8 when attaching or securing the filling region of the inliner, FIG. 11 an illustration of the transport container in accordance with FIG. 10 during filling of the inliner, FIG. 12, 13 illustrations of the transport container in accordance with FIG. 11 with closed inliner or closed filling region, FIG. 14 an illustration of the transport container during emptying, FIG. 15 an illustration of the transport container in accordance with FIG. 14 with the inliner partially pulled out, FIG. 16 an illustration of the transport container in accordance with FIG. 15 with sucked-out inliner, FIG. 17 an illustration of the transport container in accordance with FIG. 16 when the inliner is pulled out, FIG. 18 an illustration of draining any residual quantity from the inliner into a tray.

Such a transport container 12 is shown in FIG. 6. In the exemplary embodiment, it is an IBC container which, as explained at the outset, comprises a blow moulded transport container 12 accommodated in a wire mesh. In principle, such a transport container can be made of plastics materials or metal, such as stainless steel. Other materials are also usable, for example glass or cardboard packaging, such as cardboard packaging made of heavy duty corrugated cardboard.

To protect the transport container from contamination, an inliner 10 is accommodated in this transport container 12 in the exemplary embodiments.

Figure 1:
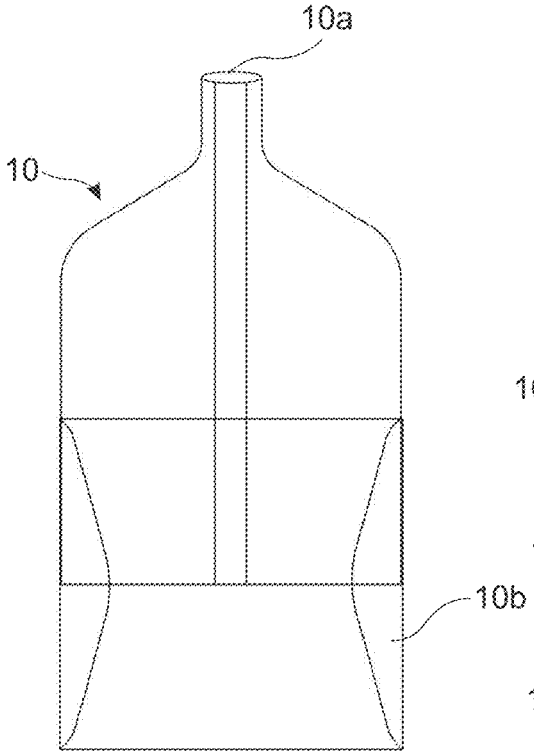
FIG. 1 a view of a laid out inliner.

In accordance with FIG. 1, the inliner 10, which is preferably made of a film, but can also be made of other suitable materials, is pre formed by welding seams and a fold so that the shape of the inliner 10 can adapt as precisely as possible to the inner shape of an IBC container or another possible transport container when it is opened. The filling region 10*a* at the top of the inliner 10 is welded into a funnel shape to make filling easier.

Figure 2:
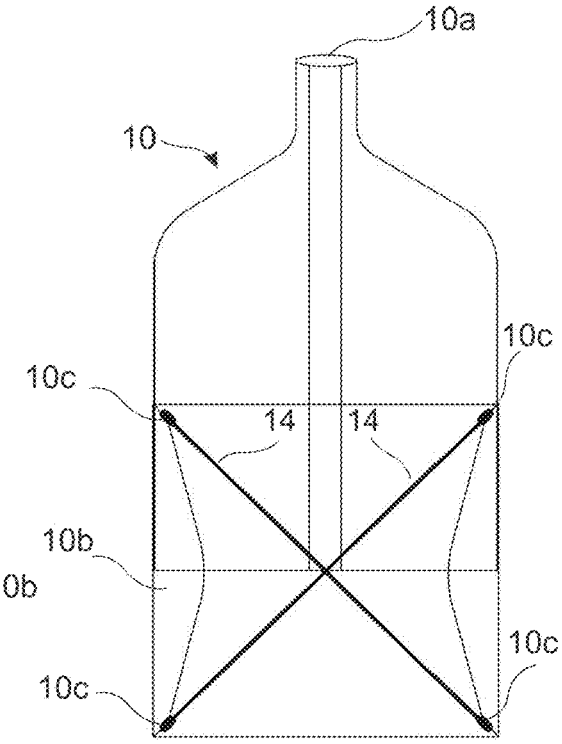
FIG. 2 an illustration in accordance with FIG. 1 with shaping rods attached to it, FIG. 3 an illustration of the inliner with deformed shaping rods, FIG. 4, 5 views of the inliner with application tube attached thereto, FIG. 6, 7 three dimensional views of a transport container into which the inliner with application tube is introduced and when the application tube is removed.

In accordance with FIG. 2, there are attached to this inliner, which can be equipped with one or more layers, shaping rods 14. The base 10*b* of the inliner 10 with flexible shaping rods 14 attached to fixing elements 10*c* is visible in the foreground. These shaping rods are preferably made of glass fibre or a flexible plastics or metal or another flexible material. The shaping rods 14 are fixedly connected to the base 10*b* of the inliner 10 by the fixing elements 10*c*. In principle, any other form of connection of the shaping rods 14 to the base 10*b* is also possible, for example gluing or welding into the film. In expanded form, the shaping rods 14 stretch the base 10*b* of the inliner 10 into a, for example, preferably rectangular shape, which corresponds to an inner surface, preferably the inner base, of the transport container 12. Preferably, the shaping rods are fixed in the base region, but can also be fixed at any other suitable location of the inliner that serves the intended purpose.

These shaping rods 14 are preferably fixed crosswise on the inside or outside of the base 10*b*, for example by means of pads made of plastic which can be glued, welded or clipped to the film of the inliner. The fixing elements 10*c* in turn fix the shaping rods 14 so that they lie splayed out on the base 10*b*. The splayed shaping rods 14 are captured at the fixing elements 10*c* and brought towards each other so that they are bent and meet at the ends. As the inliner film is fixed to the fixing elements 10*c*, it is automatically entrained and pre folded. This gives the inliner 10 a centred form.

Figure 3:
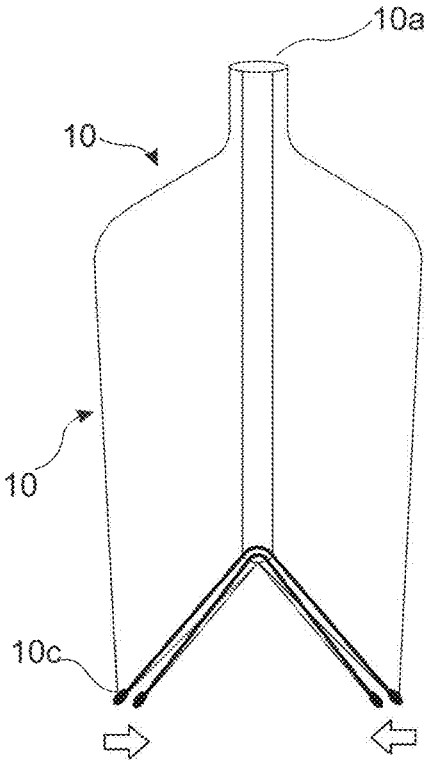

In accordance with FIG. 3, the flexible properties of the shaping rods 14 allow them to be bent under internal stress in such a way that they enable the entire inliner 10 to be folded into a very slim shape. By connecting the shaping rods 14 to the base film of the inliner at the fixing elements 10*c*, as soon as they move into their rest position or starting position, they transform the base into a flat shape that follows the shape of the inner base during expansion.

In principle, the inliner 10 is operatively connected to the shaping rods 14 in such a way that the inliner 10 in the transport container 12 opens with the shaping rods 14 in a manner comparable to an umbrella principle when the inliner is introduced into the transport container and closes when the inliner is extracted. The shaping rods preferably move here into their rest position when opening and into a deformed position when closing by pulling out the emptied inliner. The umbrella principle envisions the shaping rods 14 connected at one end to the inliner 10 and opening in a radially outward manner, pivoting away from an axis of the inliner 10, for example a central axis, The shaping rods 14 are capable of moving in the opposite direction, pivoting toward the axis to assume a closed configuration, similar to the movement of an umbrella.

The shaping rods 14 also assume this "deformed" position when they are introduced into the inliner 10, as they are received in an application tube 16 in the deformed state. Here, "deformed" means that the shaping rods 14 are preferably made of a resilient material—for example elastically deformable glass fibre rods. The shaping rods 14 are inserted into the inliner in a pre stressed state and released there to relax. For example, the shaping rods can be bent into a semi circle and are thus stressed. The application tube 16 then holds the rods pre stressed in this position until it is removed.

Figure 4:
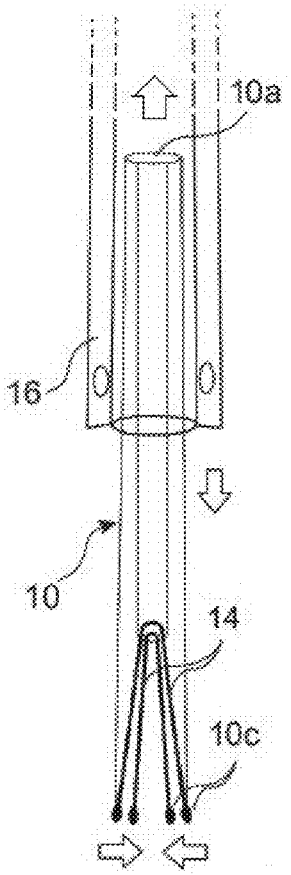
Figure 5:
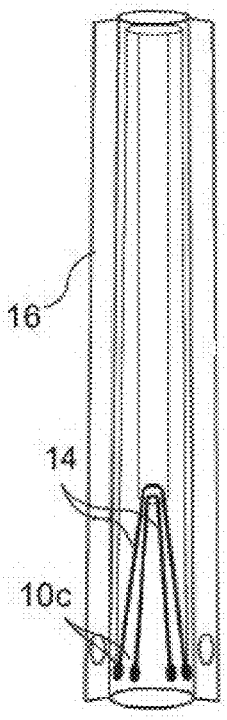

The filling opening 12*a* of the transport container 12 is generally limited in size, so that the inliner 10 must be folded to the size of the diameter of the filling opening 12*a* in order to be able to insert it through the filling opening 12*a* of the transport container 12 and into the latter. In order to prevent the inliner 10 from expanding after production and before insertion into the transport container 12, the folded inliner 10 together with the shaping rods 14 is held in the folded shape by an application tube 16 pulled over it, in accordance with FIGS. 4, 5. In their deformed position, the inliner and the shaping rods 14 are arranged to be received in the application tube 16. The outer dimensions of the application tube 16 are smaller than the filling opening 12*a* of the transport container 12. Specifically, the application tube 16 is smaller for this purpose than the cross section or diameter of the filling opening 12*a* of the transport container 12, so that the inliner 10 can be inserted through the filling opening 12*a* in folded form. As a transport safety device and simultaneous insertion aid, the application tube 16 completely encases the folded inliner 10 and also holds the folded shaping rods 14, which are under stress, in a deformed position drawn into the application tube so that the inliner 10 can be inserted through the filling opening 12*a* of the transport container 12.

Figure 6A:
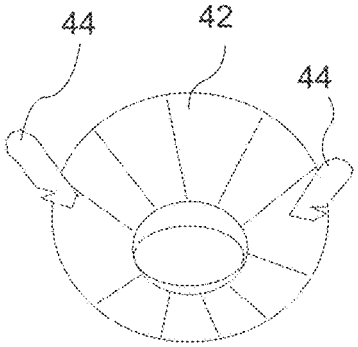

Preferably, an insertion funnel 42 in accordance with FIG. 6*a* can be attached to the filling opening 12*a* of the transport container 12. This advantageously simplifies the insertion of the folded inliner with application tube 16 and at the same time the application tube can be fixed to the stud bolts 44 attached to the insertion funnel 42, so that the application tube 16 can be removed simply by pressing in the entire inliner package. At the same time, the insertion funnel 42 serves as protection against sharp edges in the filling opening 12*a* of the transport container. However, insertion is also possible without such an insertion funnel.

Figure 7:
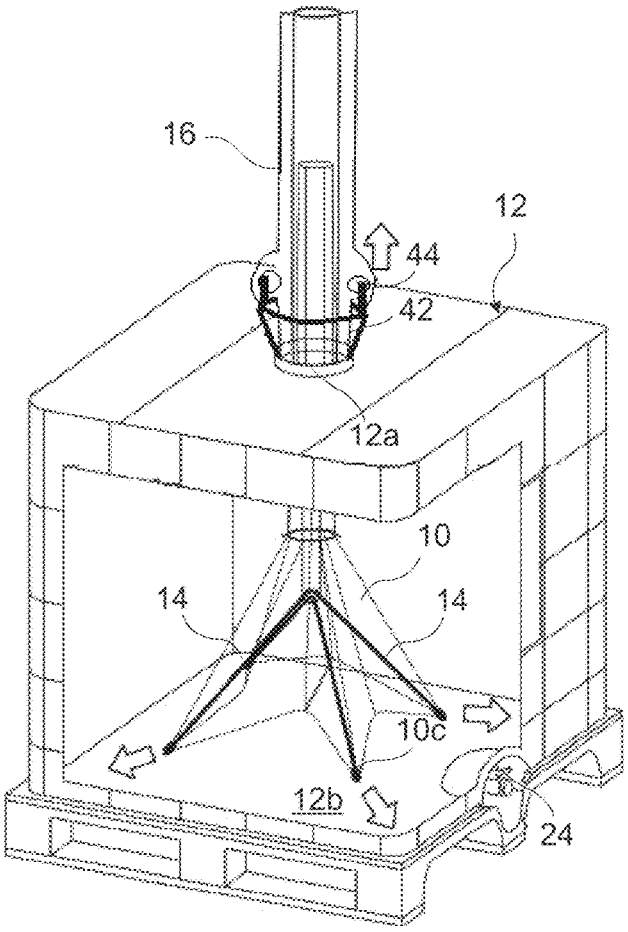

The inliner 10, which is fixed in its folded form in this position by the application tube 16, is first inserted together with the application tube 16 through the filling opening 12*a* of the transport container 12 and further inserted into the transport container in accordance with FIG. 6. In accordance with FIG. 7, the application tube 16 is preferably pulled upwards and out of the transport container 12 outside the filling opening 12*a* of the transport container 12. As a result, the flexible shaping rods 14 are released from their shape determined by the application tube and expand outwards into their original unbent shape. As a result of their fixation, for example on the base 10*b* of the inliner 10, they pull it outwards due to their internal stress. This results in a flat basic shape, in the exemplary embodiment a flat base shape, of the inliner, which follows the shape of the transport container 12.

Since the shaping rods 14 do not always open completely on their own, especially after long storage in the application tube 16, it is expedient to pull the stretched inliner upwards a few times at the filling region through the filling opening 12*a* and then to let it sink back down towards the base of the transport container 12. The up and down movement creates an air cushion under the inliner base stretched by the shaping rods 14, which escapes upwards around the sides of the base and thus spreads out the inliner base even better in the transport container 12.

Figure 8:
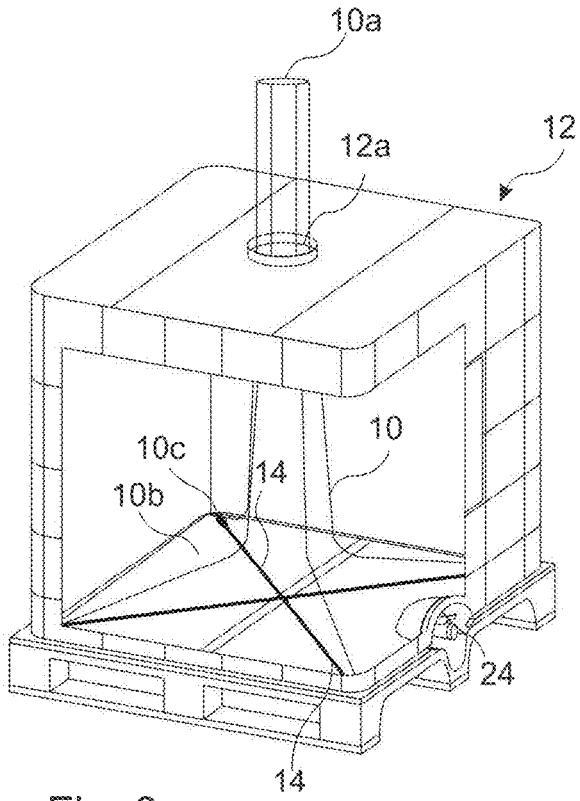

According to FIG. 8, the base 10*b* of the inliner 10 is drawn into a flat shape by the shaping rods 14 expanded in this way, which corresponds to the shape of the inner base of the transport container 12, for example. As a result, it lies flat on the inner base of the transport container 12 or flat against another surface of the transport container.

Figure 9:
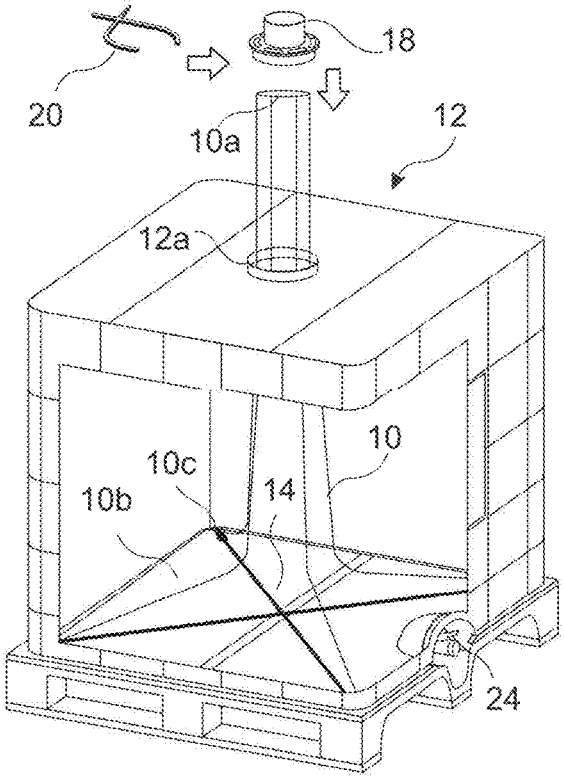

The funnel shaped filling region 10*a* of the inliner 10 protrudes upwards through the filling opening 12*a* of the transport container 12. In accordance with FIG. 9, a moulded part 18 is drawn over this region, which makes it possible to fix the funnel shaped filling region 10*a* of the inliner 10 during the filling process by means of a clamp 20 to prevent the filling region from possibly slipping into the transport container 12. At the same time, the moulded part 18 allows the air displaced from the transport container 12 during filling of the inliner 10 to escape safely to the outside through air holes 18*a*.

Figure 10:
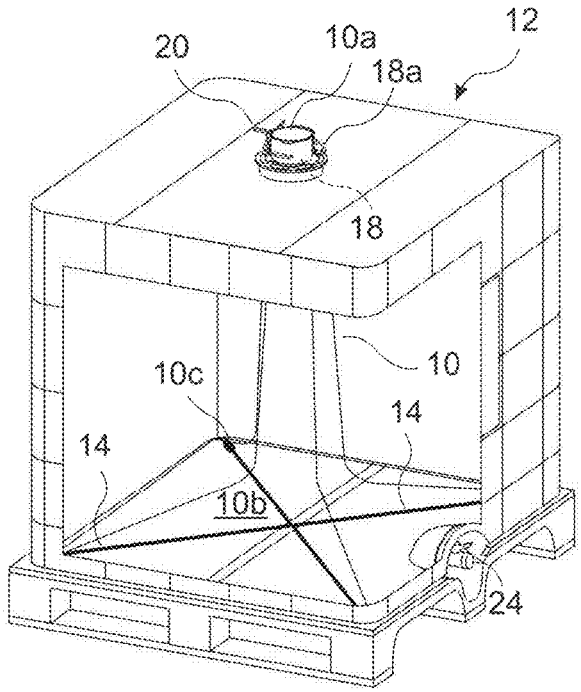

The filling region 10*a* of the inliner 10 is secured in the moulded part 18 in accordance with FIG. 10 by means of a clamp 20 to prevent it from slipping into the transport container 12.

Figure 11:
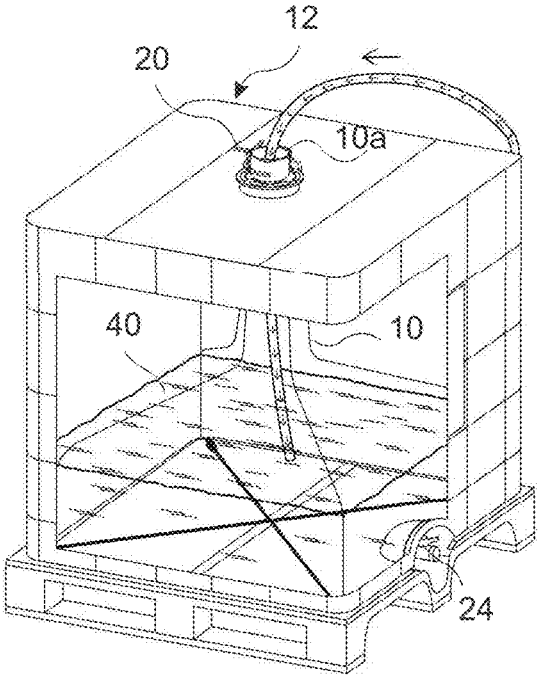
Figure 12:
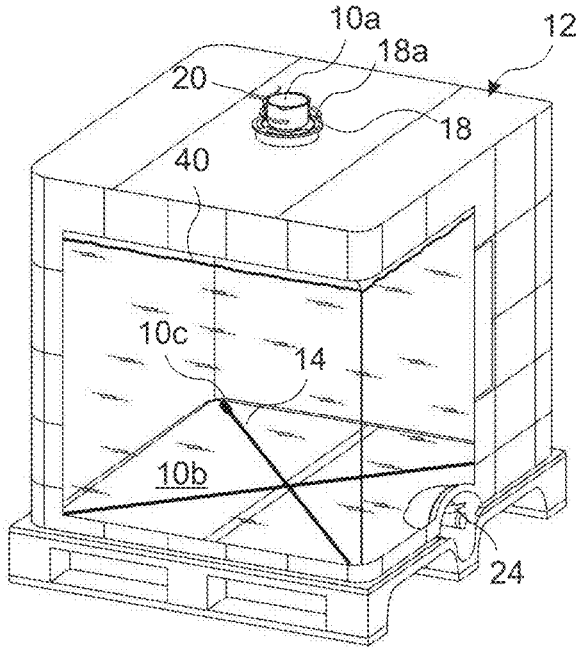

The inliner can now be filled with filling material in accordance with FIG. 11 and opens upwards into the transport container 12, starting from the base region, due to the rising filling material 40, in order to line the transport container. In doing so, the inliner lies snugly and precisely against the inner walls of the transport container 12.

Figure 13:
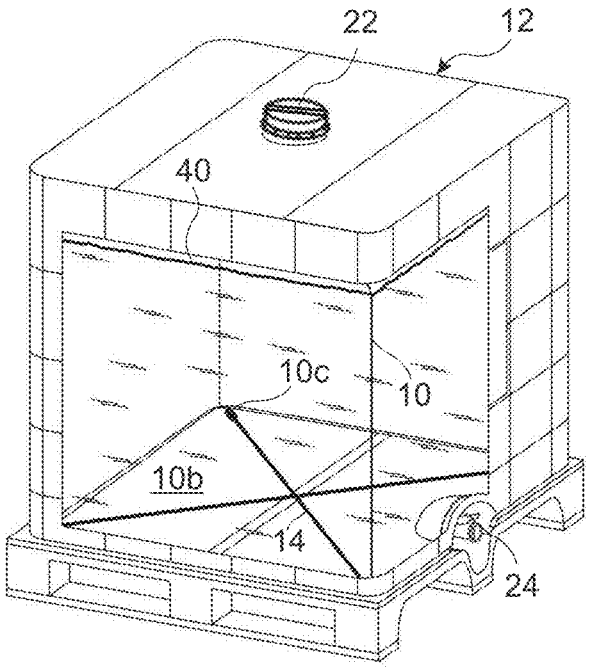

After filling, the filling region 10*a* of the inliner 10 is closed, for example with a cable tie or an appropriate material for binding, and is folded inwards into the transport container 12. The transport container 12 can be closed for safe transport by the original lid 22 at the top at the filling opening 12*a* and at the bottom at the valve 24 in accordance with FIG. 13.

Figure 14:
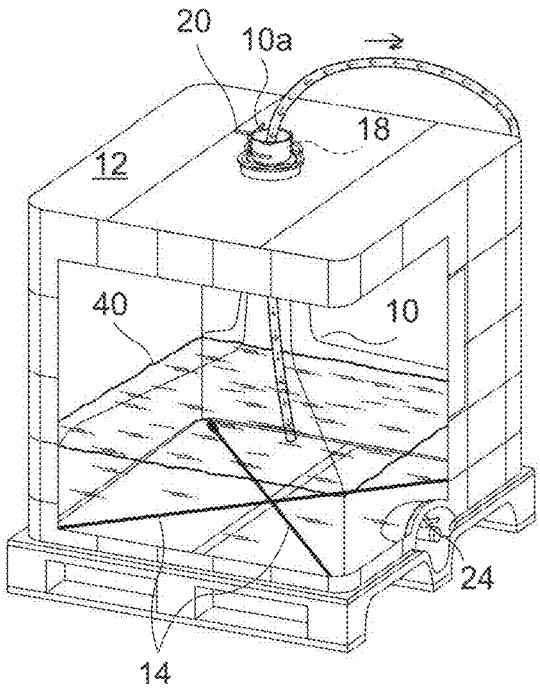
Figure 15:
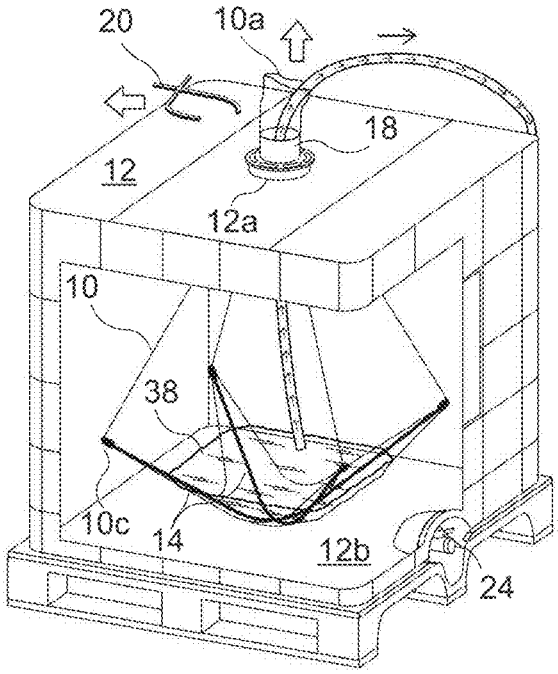
Figure 16:
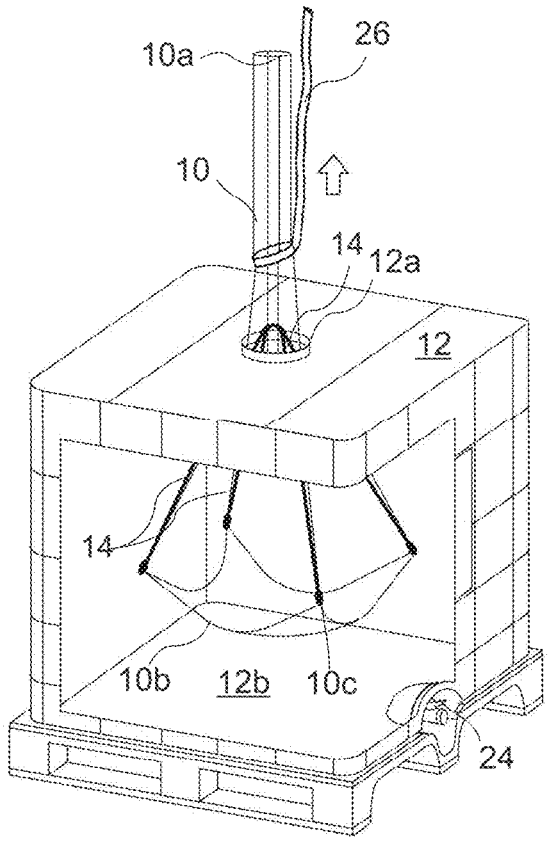

For emptying, the liquid in the inliner 10 is suctioned out from above through the filling opening 12*a* of the transport container 12 and the filling region 10*a* of the inliner 10 in accordance with FIG. 14. As much liquid as possible is sucked out of the inliner 10 down to a residual quantity in the base region. In order to concentrate this in the centre as in a sump 38, the inliner 10 is pulled upwards at the filling region 10*a* so that a sump like tank is formed (FIG. 15). The residual quantity can now be extracted. Preferably, a rigid suction lance with a small filter basket should be used for this. This allows the liquid to be removed almost completely without the inliner sticking to the suction lance. Once the liquid has been extracted down to a small residual quantity, the suction lance or the suction hose is removed.

Figure 17:
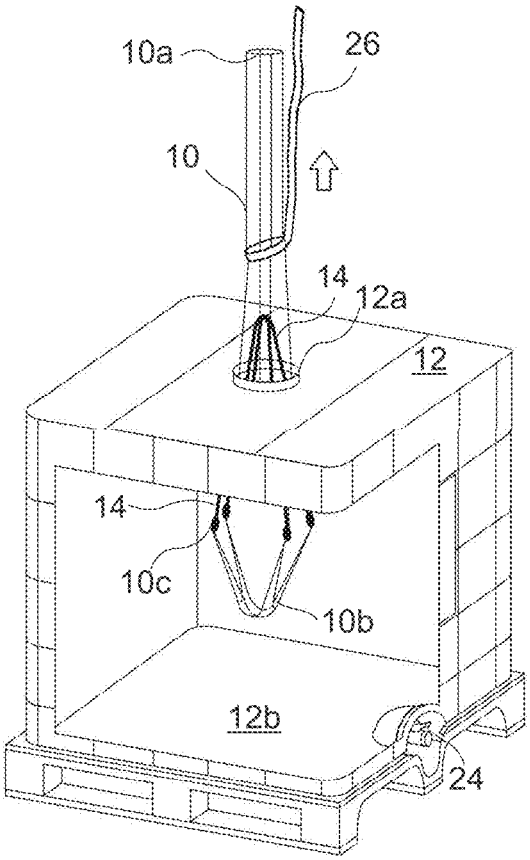

Now, in accordance with FIG. 17, the inliner 10 is pulled upwards in the direction of the arrow, whereby the flexible shaping rods 14 bend into a U shape due to the contact with the filling opening 12*a* of the transport container and the pulling force, so that they can be pulled upwards and outwards together with the inliner 10, for example by pulling with a loop belt 26 wrapped around the upper region of the inliner 10, which loop belt is pulled upwards by the fork of a forklift truck or by another lifting device.

When removing by hand, the inliner 10 is pulled upwards on any side until one of the shaping rods 14 with fixing elements 10*c* is visible in the filling opening 12*a* of the transport container 12. This first shaping rod is first pulled out with one of its fixing elements 10*c*, followed by the film of the inliner 10, and then the other ends of the two shaping rods 14 with fixing elements 10*c*, which were previously located in the inner region of the transport container 12, are pulled out piece by piece.

Figure 18:
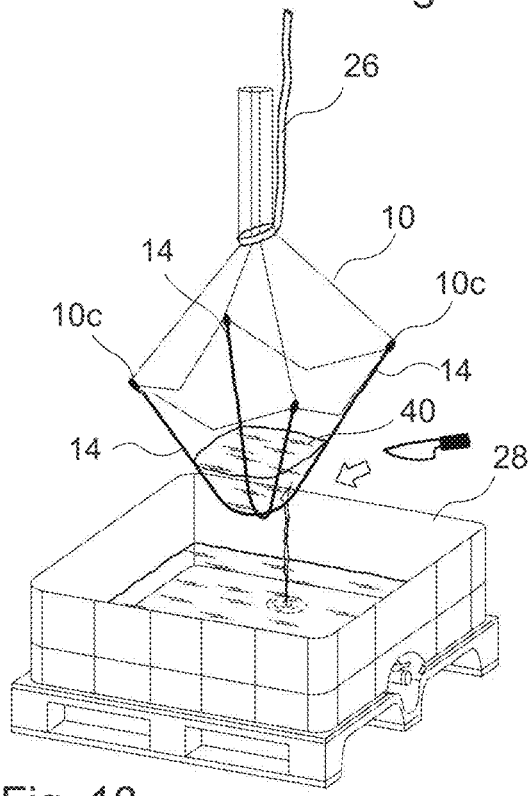

Should there still be a small residual quantity in the inliner 10, it can be swung over a tank 28, for example, in accordance with FIG. 18 and cut open there, for example with a cutter knife, so that the residual quantity can flow out and the inliner can then be sent for thermal recycling. A new inliner is then drawn into the now empty transport container 12.

The transport container can now be re-fitted with an inliner for the next filling.

The inliner 10 equipped with the shaping rods 14, together with the application tube 16, in which the inliner 10 and the shaping rods 14 are receivable in their deformed position and the outer dimensions of which are smaller than a filling opening 12*a* of the transport container 12, forms a composite package which is arranged for introducing an inliner 10 through an opening in a container wall of a transport container 12. It can be made available in this form to users of such transport containers and is readily deployable quickly and easily.

Likewise, the composite package may additionally comprise the moulded part 18 in order to fix the inliner 10 after introduction into the transport container 12 at the filling opening 12*a* of the latter, the moulded part 18 preferably having air holes 18*a*.

On a transport container 12, which has a filling opening 12*a* and optionally an outlet opening 36 and is provided with the inliner 10 arranged in the transport container 12, the inliner 10 can preferably be securable at the filling opening 12*a*.

The invention claimed is:

1. An inliner, configured for receiving filling material and for being introduced through an opening in a container wall of a closed transport container, the inliner comprising:

at least two shaping rods configured to open with the inliner in the transport container in a direction radially outward of an axis when the inliner is introduced into the transport container and to close in a direction radially inward towards the axis when the inliner is extracted, wherein the at least two shaping rods comprise a flexible, resilient material and, as a result of an internal stress, are transferable from a deformed position into a rest position corresponding to the open position of the inliner, wherein fixing elements are provided on the inliner for securing the at least two shaping rods at the inliner, wherein the at least two shaping rods, in the rest position, lie one above the other at at least one point and stretch an area of the inliner at the corners of which area the fixing elements are provided.

2. The inliner in accordance with claim 1, wherein the area is configured to cover at least one of an inner surface or a base surface of the transport container.

3. The inliner in accordance with claim 1, wherein the at least two shaping rods are glass fibre rods.

4. The inliner in accordance with claim 1, wherein the inliner and the at least two shaping rods in the deformed position are configured to be receivable in an application tube, the outer dimensions of the application tube are smaller in cross-section than a filling opening of the transport container.

5. A composite package configured for introducing an inliner through an opening into a container wall of a transport container, said composite package comprising an inliner, equipped with at least two shaping rods, in accordance with claim 1, an application tube, in which there are receivable the inliner and the at least two shaping rods in a deformed position, the outer dimensions of the application tube being smaller than a filling opening of the transport container.

6. The composite package in accordance with claim 5, further comprising a moulded part configured to fix the inliner after introduction into the transport container at the filling opening thereof.

7. The composite package in accordance with claim 6, wherein the moulded part comprises air holes.

8. A transport container with an the inliner in accordance with claim 1.

9. The transport container in accordance with claim 8, further comprising a filling opening and provided with the inliner arranged in the transport container, the inliner being securable at the filling opening.

10. A method for introducing the inliner in accordance with claim 1, into a transport container through an opening in a container wall of the transport container, said method comprising the steps of:

establishing an operative connection between shaping rods and the inliner, transferring the shaping rods into a deformed position by inserting the shaping rods and the inliner into an application tube, introducing the application tube with the inliner and the shaping rods received therein through a filling opening into the transport container, pulling off the application tube while releasing the shaping rods, which thereby stretch the inliner and move to the rest position on an inner surface of the transport container.

11. The method in accordance with claim 10, wherein the following steps are carried out to empty the inliner located in the transport container, removing the filling material, pulling the inliner upwards to form a sump, removing the filling material from the sump, removing the inliner from the transport container.

12. The method in accordance with claim 11, wherein the filling material is removed down to a residual quantity of filling material.

13. The method in accordance with claim 11, wherein the inliner is pulled upwards to form the sump above the shaping rods.

14. An inliner, configured for receiving filling material and for being introduced through an opening in a container wall of a closed transport container, the inliner comprising:

at least two shaping rods configured to open with the inliner in the transport container in a direction radially outward of an axis when the inliner is introduced into the transport container and to close in a direction radially inward towards the axis when the inliner is extracted, wherein the at least two shaping rods comprise a flexible, resilient material and, as a result of an internal stress, are transferable from a deformed position into a rest position corresponding to the open position of the inliner, wherein fixing elements are provided on the inliner for securing the at least two shaping rods at the inliner, wherein the at least two shaping rods, in the rest position, lie one above the other at at least one point, are fixed crosswise on the inside or outside of the base of the inliner and stretch an area of the inliner at the corners of which area the fixing elements are provided.

* * * * *